US009689608B2

(12) United States Patent
Beeler

(10) Patent No.: US 9,689,608 B2
(45) Date of Patent: Jun. 27, 2017

(54) METHODS AND DEVICES FOR DRYING HYDROCARBON CONTAINING GAS

(71) Applicant: Leed Fabrication Services, Inc., Brighton, CO (US)

(72) Inventor: Casey L. Beeler, Lone Tree, CO (US)

(73) Assignee: Leed Fabrication Services, Inc., Brighton, CO (US)

( * ) Notice: Subject to any disclaimer, the term of this patent is extended or adjusted under 35 U.S.C. 154(b) by 444 days.

(21) Appl. No.: 14/209,507

(22) Filed: Mar. 13, 2014

(65) Prior Publication Data

US 2014/0260335 A1 Sep. 18, 2014

Related U.S. Application Data

(60) Provisional application No. 61/782,214, filed on Mar. 14, 2013.

(51) Int. Cl.
*F25J 3/00* (2006.01)
*F25J 3/06* (2006.01)
(Continued)

(52) U.S. Cl.
CPC ..... *F25J 3/061* (2013.01); *C10L 3/101* (2013.01); *F25B 9/04* (2013.01); *F25J 3/064* (2013.01); *F25J 3/0635* (2013.01); *F25J 3/0645* (2013.01); *F25J 2220/64* (2013.01); *F25J 2230/20* (2013.01); *F25J 2240/90* (2013.01)

(58) Field of Classification Search
CPC F25J 1/0228; F25J 1/0022; F25J 3/061; F25J 3/0615; F25J 1/0283; F25J 2220/64; F25J 2230/22; F25J 2240/90; F25J 2240/02; F25J 2240/30; F25B 9/004; F25B 9/04
See application file for complete search history.

(56) References Cited

U.S. PATENT DOCUMENTS 1,061,206 A 5/1913 Tesla
3,007,311 A 11/1961 Amero
(Continued)

FOREIGN PATENT DOCUMENTS

GB 1099479 1/1968
WO WO 2009/131477 10/2009
(Continued)

OTHER PUBLICATIONS

"Vortex Tubes for Spot Cooling" , Newman Tools Inc., http://newmantools.com/vortex.htm; Last Updated Dec. 2009.*
(Continued)

*Primary Examiner* — Keith Raymond
(74) *Attorney, Agent, or Firm* — Lathrop & Gage LLP

(57) ABSTRACT

Processes and devices for recovering natural gas liquid from a hydrocarbon containing gas are provided by introduction of compressed air to a vortex tube. The vortex tube generates a cold air stream that is introduced into a heat exchanger. A hydrocarbon containing gas of higher temperature than the cold air stream is introduced into the heat exchanger, so that the cold air stream in the heat exchanger cools the hydrocarbon containing gas to condense natural gas vapors in the hydrocarbon containing gas to liquid hydrocarbons. In this manner, liquid hydrocarbons and dry hydrocarbon containing gas are obtained.

18 Claims, 5 Drawing Sheets

(51) Int. Cl.
*F25B 9/04* (2006.01)
*C10L 3/10* (2006.01)

(56) References Cited

U.S. PATENT DOCUMENTS

| | | | | |
|---|---|---|---|---|
| 3,074,243 | A | 1/1963 | Tilden | |
| 3,173,273 | A | 3/1965 | Fulton | |
| 3,208,229 | A | 9/1965 | Fulton | |
| 3,775,988 | A | 12/1973 | Fekete | |
| 5,483,801 | A | 1/1996 | Craze | |
| 6,174,127 | B1 | 1/2001 | Conrad et al. | |
| 6,327,858 | B1 * | 12/2001 | Negre | F01B 17/02 60/650 |
| 6,779,964 | B2 | 8/2004 | Dial | |
| 6,932,858 | B2 | 8/2005 | Nicol et al. | |
| 7,695,242 | B2 | 4/2010 | Fuller | |
| 7,780,766 | B2 | 8/2010 | Thompson | |
| 7,837,768 | B2 | 11/2010 | Sanderson et al. | |
| 2001/0027652 | A1 | 10/2001 | White | |
| 2002/0064469 | A1 * | 5/2002 | Palumbo | F01D 1/36 417/407 |
| 2002/0185006 | A1 * | 12/2002 | Lecomte | B01D 53/002 95/231 |
| 2005/0169743 | A1 | 8/2005 | Hicks | |
| 2006/0150643 | A1 | 7/2006 | Sullivan | |
| 2007/0116554 | A1 | 5/2007 | Brewer | |
| 2007/0274858 | A1 | 11/2007 | Childers et al. | |
| 2010/0031700 | A1 * | 2/2010 | Wilkinson | F25J 1/0022 62/620 |
| 2011/0097189 | A1 | 4/2011 | Sandoval et al. | |
| 2012/0007368 | A1 * | 1/2012 | Silva Valente | F01D 1/36 290/1 R |
| 2013/0068314 | A1 | 3/2013 | Beeler | |
| 2013/0071259 | A1 | 3/2013 | Beeler | |

FOREIGN PATENT DOCUMENTS

| | | |
|---|---|---|
| WO | WO 2010/031162 | 3/2010 |
| WO | WO 2011/014187 | 2/2011 |
| WO | WO 2013/040334 | 3/2013 |
| WO | WO 2013/040338 | 3/2013 |

OTHER PUBLICATIONS

International Search Report with Written Opinion corresponding to International Patent Application No. PCT/US2014/026199, mailed Jul. 10, 2014.

International Search Report with Written Opinion corresponding to International Patent Application No. PCT/US2012/055388, mailed Jan. 4, 2013.

International Search Report with Written Opinion corresponding to International Patent Application No. PCT/US2012/055381, mailed Jan. 24, 2013.

Newman Tools Inc. (Dec. 2009) "Vortex Tubes for Spot Cooling: Cooling with Compressed Air," *Newman Tools Inc*. http://newmantools.com/vortex.htm [Accessed Jul. 23, 2014].

U.S. Environmental Protection Agency (Mar. 2011) "Natural Gas Star Recommended Technologies and Practices—Production Sector," *U.S. Environmental Protection Agency*. pp. 1-2.

U.S. Environmental Protection Agency (Oct. 2006) "Convert gas pneumatic controls to instrument air," *U.S. Environmental Protection Agency*. pp. 1-12.

U.S. Environmental Protection Agency (Oct. 2006) "Options for reducing methane emissions from pneumatic devices in the natural gas industry," *U.S. Environmental Protection Agency*. pp. 1-12.

* cited by examiner

METHODS AND DEVICES FOR DRYING HYDROCARBON CONTAINING GAS

CROSS-REFERENCE TO RELATED APPLICATIONS

This application claims the benefit of U.S. Provisional Application No. 61/782,214, filed Mar. 14, 2013, which is hereby incorporated by reference in its entirety to the extent not inconsistent herewith.

BACKGROUND OF THE INVENTION

Provided are devices and methods for condensing hydrocarbon vapors from a hydrocarbon containing gas using energy inherent to the industrial process. In this manner, the process is extremely energy efficient with attendant increase in revenue to the producer without sacrifice in process reliability or efficiency.

Vortex tubes or Ranque-Hilsch vortex tubes are known in the art and are used to provide spot cooling. Vortex tubes, however, are generally not used in conventional cooling equipment because they are of relatively low efficiency. In addition, for substantial cooling, highly compressed air is required. Vortex tubes have certain advantages if the above concerns can be addressed as cooling via vortex tubes does not require external energy or a special refrigerant, so long as the fluid introduced to the vortex tube is of sufficiently high pressure. For example, a vortex tube does not have moving parts, electricity or special refrigerants. This makes vortex tubes a potentially reliable and robust means for cooling.

Provided herein are industrial processes that incorporate the advantages of vortex tubes outlined above in recovering natural gas liquids (NGL) from a hydrocarbon containing gas by condensing natural gas vapors in the gas and collecting the condensed NGL. The processes are reliable, robust, extremely energy efficient and environmentally responsible, and provides the ability to collect commercially valuable NGL that may otherwise be wasted. Such collection of NGL for subsequent sale or use provides a revenue stream that relatively quickly pays off any capital and/or installation costs associated with the system. The fact that the processes and systems provided herein do not require moving parts, electricity, or special refrigerants ensures that ongoing maintenance and operating costs are minimal compared to conventional systems.

SUMMARY OF THE INVENTION

Provided herein are processes and devices for processing a hydrocarbon containing gas. In particular, the systems decrease the temperature of the hydrocarbon containing gas such that hydrocarbon vapors condense and are removed from the gas. The advantages of the instant disclosure are that the systems do not require significant external energy and, in certain embodiments, are self-sufficient and self-maintaining. In this manner, valuable end products are obtained, such as natural gas liquids (NGLs) condensed from a hydrocarbon containing gas whose value may otherwise not be fully captured. Furthermore, hydrocarbon containing gas is dried and may also be collected or, as desired, more reliably combusted compared to wet gases containing mixture of hydrocarbons, including relatively heavy hydrocarbons that are not removed via the instant condensation process. These functional benefits are all provided without any complex equipment, materials, refrigerants or additional energy requirements. Accordingly, the payoff timeframe for the systems and methods provided herein is rapid and reliable.

In an embodiment, the process is for recovering natural gas liquid from a hydrocarbon containing gas by introducing compressed air to a vortex tube. The vortex tube separates the introduced compressed air into a hot air stream and a cold air stream. The cold air stream is introduced into a heat exchanger into which a hydrocarbon containing gas is also introduced. The cold air stream in the heat exchanger cools the hydrocarbon containing gas thereby condensing natural gas vapors in the hydrocarbon containing gas to liquid hydrocarbons. The liquid hydrocarbons and the dry hydrocarbon containing gas are each separately collected from the heat exchanger. In this manner, natural gas liquids are recovered from the hydrocarbon containing gas.

The processes and systems provided herein permit control of fluid pressures, flow-rates and/or temperatures at various locations by the use of controllers, sensors and valves. In an aspect, the introduced compressed air has a pressure selected from a range that is greater than or equal to 80 psi and less than or equal to 120 psi. In an aspect, the introduced compressed air has an introduction temperature, such as an introduction temperature selected from a range that is greater than or equal to 50° F. and less than or equal to about 90° F. In another aspect, compressed air introduction temperature is within about 10° F. of surrounding ambient air temperature. Furthermore, any of the gas streams provided herein may be employed to effect a temperature change or for temperature control, such as by thermal contact with any of the conduits, containment vessels, or components.

The system and process may be further described in terms of the temperature of the cold air stream and/or hot air stream departing the vortex tube. For example, the cold air stream from the vortex tube can have a temperature selected from a range that is greater than or equal to −20° F. and less than or equal to about 20° F. In another example, the cold air stream has an exit temperature from the vortex tube that is at least 30° F. to 100° F. less than an introduction temperature of the introduced compressed air. The hot air stream may have a temperature on the order of about 150° F. to 200° F.

The cold air stream has a flow rate selected depending on the operating conditions and heat transfer requirements of the heat exchanger.

Any of the systems and processes provided herein utilize a special configuration for compressing air, such as by mechanically coupling a boundary layer disk turbine (BLDT) to a compressor pump, directing a flow of a pressurized drive fluid over the BLDT to mechanically power the compressor pump, and compressing air with the mechanically powered compressor pump. In this manner, an external energy source is not required to power the compressor, and the NGL recovery can occur without external power consumption.

In an aspect, the compressed air is stored in a storage tank. In an aspect, the compressing is without an external energy source. In an aspect, the pressurized drive fluid is a vapor gas from a hydrocarbon containing liquid.

In an embodiment, any of the processes provided herein optionally further comprise the step of providing on-demand control of a pneumatic device within the process, such as by use of the compressed air.

In an aspect, the hydrocarbon containing gas introduced to the heat exchanger is from a separation tank or a production field and comprises condensable hydrocarbons of C2 or greater. In an embodiment, the mole percentage of the condensable hydrocarbons is 20% or greater. In an embodiment, the collected dry hydrocarbon gas comprises methane hydrocarbons in an amount that is greater than or equal to 95 mol %. In an embodiment, the collected dry hydrocarbon gas is provided to a sales line or combusted.

In an embodiment, the collected NGL comprises one or more of: ethane, butane or propane, such as a mixture thereof or individually separated. In an aspect, the collected NGL is stored in a containment vessel or introduced to a sales pipeline.

Also provided is an apparatus for performing any of the processes disclosed herein, such as an apparatus for recovering natural gas liquids from a hydrocarbon-containing gas. In an embodiment, the apparatus comprises a heat exchanger. The heat exchanger may be described in terms of having a number of inlets for introducing fluids to a thermal transfer zone, such as a first inlet for receiving a hydrocarbon stream comprising wet natural gas and a first outlet for releasing a cooled hydrocarbon stream that is dry natural gas from the hydrocarbon stream. A second inlet receives a cold air stream and a second outlet releases a heated air stream, wherein the cold air stream and the hydrocarbon stream comprising wet natural gas are in thermal contact, and the cold air stream cools the hydrocarbon stream resulting in dry natural gas and a heated air stream. A third outlet releases a condensed natural gas liquid (NGL) from the cooled hydrocarbon stream. A vortex tube separates compressed air into a cold air stream at a first end and a hot air stream at a second end. A cold air stream conduit fluidly connects the vortex tube first end to the heat exchanger second inlet for introducing the cold air stream to the heat exchanger. A NGL collection vessel is connected to the heat exchanger third outlet for collecting a condensed NGL from the cooled hydrocarbon stream. The third outlet optionally corresponds to a collection chamber having a gravity-fed drain through which condensed liquid pools and is removed from the heat exchanger.

Any of the apparatus and systems provided herein optionally further comprise a self-powered compressor to compress air that is subsequently introduced to the vortex tube. The self-powered compressor comprises a boundary layer disc turbine (BLDT) and a source of pressurized drive fluid. A pressurized drive fluid conduit fluidically connects the BLDT and the source of pressurized drive fluid. A compressor pump is mechanically connected to the BLDT. An air source is fluidically connected to the compressor pump, wherein flow of pressurized drive fluid under a pressure differential mechanically powers the compressor pump to compress air to a desired pressure for introduction to the vortex tube. Optionally, the apparatus further comprises a compressed air storage tank fluidically connected to the compressor pump for storing compressed air.

In an aspect, no external power source is required for carrying out any of the processes described herein or for any apparatus described herein.

Any process or apparatus provided herein may further comprise a self-powered compressor, as described in PCT Pub. nos. WO 2013/040334 and WO 2013/040338, and U.S. Pat. Pub. numbers 2013/0071259 and 2013/0068314 by Casey Beeler, each filed Sep. 14, 2012, which are specifically incorporated by reference herein to the extent they are not inconsistent herewith.

The process and devices provided herein relate to a compressor in an industrial process that does not require chemical power (e.g., from combustion of a hydrocarbon fuel) or electric power. The compressor is responsible for providing a means to control one or more parameters of the industrial process, such as controlling air and/or gas pressure, and devices related thereto. A central aspect of the process relates to harnessing the kinetic energy inherent in a pressurized fluid flow, running through optionally a closed loop fitted with appropriate regulators and valves to control pressure gradients and input power, to provide a motive force to drive a BLDT. The BLDT in turn drives a compressor pump that compresses a fluid and optionally stores the compressed fluid in an appropriately sized pressure vessel or tank.

Provided herein are various industrial processes, and systems that incorporate those industrial processes, wherein one component of the process relates to a flow of a drive fluid that is an integral part of the industrial process. Flow of the drive fluid is used to provide power or control to other components of the process. In this manner, the flowing fluid itself can significantly reduce the requirement for an external power source to control or drive the process, including to drive specific components thereof. In an aspect, the drive fluid may be the gas phase portion of a hydrocarbon recovery or storage unit, such as a vapor gas that flashes from the liquid phase. The vapor gas may be under pressure, and released to a conduit connected to a boundary layer disk turbine (BLDT), so that the pressurized vapor gas flows over the BLDT under a pressure gradient, thereby mechanically driving the BLDT. The BLDT can then be connected and employed in various configurations to advantageously drive other components depending on the specific industrial process. For example, pneumatics can be powered by connecting the BLDT to a compressor pump to compress a compressible fluid, such as air, wherein the compressed fluid is controllably used to power pneumatics as desired. Alternatively, the compressor pump may compress a hydrocarbon vapor gas to a desired pressure, such as to a desired sales or pipeline pressure. Alternatively, the compressor pump may compress air to a desired compression pressure. Alternatively, the BLDT can be used to both compress hydrocarbon vapor gas and/or to compress another fluid, such as air, to run a pneumatic device within the industrial process and/or for cooling a hydrocarbon containing gas to remove condensable heavy hydrocarbons from the gas.

In an aspect, provided is a method of compressing a compressible fluid in an industrial process by mechanically coupling a boundary layer disk turbine (BLDT) to a compressor pump and directing a flow of a pressurized drive fluid over the BLDT to mechanically power the compressor pump. The compressor pump is mechanically powered by the BLDT and is capable of compressing a compressible fluid. Accordingly, the compressing of the compressible fluid optionally occurs without electrical or chemical power, relying instead on the kinetic energy of flowing drive fluid over the BLDT. In an aspect where it is desired to conserve energy, such as by industrial processes that are not connected to the grid, or by industrial processes where a goal is to conserve energy and/or reduce emissions, no electrical or chemical power is used to drive the compressor, and optionally no external power is required to control and/or drive the industrial process. Instead, all required power is derived from the fluid flow over the BLDT and the BLDT mechanically powering a compressor.

In another embodiment, provided is a method for powering a pneumatic device in an industrial process application by mechanically coupling a boundary layer disk turbine (BLDT) to a compressor pump and directing a flow of a pressurized drive fluid over the BLDT to mechanically power the compressor pump. A compressible fluid is compressed with the mechanically powered compressor pump, and the compressed fluid is used to power the pneumatic device. In this manner, a pneumatic device can be controlled without the need for any external energy, but instead indirectly relies on the kinetic energy of flow of pressurized fluid inherently a part of the industrial process.

In another embodiment, provided is a hydrocarbon vapor recovery method comprising mechanically coupling a boundary layer disk turbine (BLDT) to a compressor pump and directing a flow of a pressurized drive fluid over the BLDT to mechanically power the compressor pump. A flashed hydrocarbon vapor is compressed to a user-specified pressure by the mechanically powered compressor pump, thereby recovering hydrocarbon vapor, including at a desired user-selected pressure.

In an aspect, the pressurized drive fluid described in any of the methods or devices herein used to power the BLDT is from the industrial process itself. For example, the fluid can be a flashed vapor gas portion captured from a hydrocarbon recovery process, such as flashed vapor from a liquid hydrocarbon in a pressure vessel. Once adequate pressure is achieved for the vapor gas in the pressure vessel, the vapor gas is introduced to the BLDT by a controller connected to a conduit or pipe, with the flow of vapor gas driving the BLDT. The BLDT is then used to drive another component such as a compressor pump that can compress a fluid, including the flashed vapor gas that is driving the BLDT and/or air used to control a pneumatic device important for controlling one or more aspects of the industrial process. Other examples of drive fluid include water, petroleum or gas phases thereof.

In an embodiment, the boundary layer disk turbine is directly coupled to the compressor pump, such as a shaft that turns with the turbine and that directly drives compressive components of the compressor (e.g., pistons), or by a direct gear-to-gear coupling between the turbine and compressor. Alternatively, the boundary layer disk turbine is indirectly coupled to the compressor pump. "Indirect coupling" refers to one or more independent components that are connected between the BLDT and the compressor that assist in power transmission, such as a chain or belt to drive a flywheel and that can be engaged by a clutch. For example, the mechanical coupling optionally may include a pulley, a chain, and/or clutch to facilitate controlled power transmission from the BLDT to the compressor pump. In this manner, the compressor pump may be disengaged from the BLDT as desired and to provide different power transmission to the compressor pump.

In an aspect, the flow of drive fluid is provided in a closed loop. This is particularly useful wherein the drive fluid comprises a vapor gas flashed from a hydrocarbon liquid contained in a pressure vessel, and the flow is provided to a gas outlet pipeline or back to a pressure vessel for further use. Similarly, the vapor gas may be directed for further processing such as by removing condensable hydrocarbon vapor, thereby drying the hydrocarbon gas. In this manner, the drive fluid is not lost or vented to atmosphere, but instead is subsequently further used, processed or captured in the industrial process after passing over the BLDT. Alternatively, the flow of drive fluid is in an open loop, wherein at least a portion of the drive fluid is released to the atmosphere. This can be useful where the drive fluid is of little economic or functional importance, such as drive fluid that is air or water.

In an aspect, the compressed compressible fluid is stored in a retention tank or other holding or separation vessel.

In an embodiment, the compressible fluid comprises air, such as room or environmental air, and the compressed air is provided to a pneumatic device, thereby powering the pneumatic device or to a vortex tube, thereby generating a cold air stream. In an aspect, "powering" refers to controlling a pneumatic device, such as a controller (liquid level, temperature), pressure regulator, pressure sensor, valve, flow sensor, flow regulator, compressor, actuator. In an aspect, the air-source is ambient air from the environment in which the industrial process and system is operating.

In an embodiment where the compressed compressible fluid is stored in a retention tank, pressure is optionally monitored in the retention tank. In this manner, the compression of the compressible fluid is controlled. For example, when the monitored pressure falls below a user-selected set-point, the BLDT and compressor are engaged to pressurize the retention tank to a value above the user-selected set-point. Similarly, compression of the compressible fluid may be controllably discontinued and the compressing step stopped when the retention tank is fully pressurized. There are many possible configurations to controllably discontinue the compression, such as by stopping the flow of drive fluid to the BLDT when the retention tank is fully pressurized by a controller, thereby stopping fluid compression in the retention tank. Alternatively, the BLDT may continue to run, but the mechanical coupling with the compressor be uncoupled or disengaged from the BLDT, such as by a clutch or switch. In an aspect, the compressor may continue to run, but instead compress fluid at a different functional location, such as to a second retention tank.

In an aspect, any of the methods and systems provided herein may utilize a compressor that operates without an electrical or hydrocarbon energy source. In other words, the compressor does not require an external source of energy, but instead is powered by an inherent part of the industrial process, namely the flow of a drive fluid over the BLDT that is mechanically coupled to the compressor. In this manner, no additional source of power (e.g., electrical or chemical fuel) is required to drive the compressor. Similarly, other components in the system, such as valves or controllers in the NGL recovery method can be powered by the BLDT and attendant compression, such as by the use of components that are pneumatic in nature.

In an embodiment, the mechanical energy of the spinning BLDT and connection to compressor pump and other devices in the industrial process is sufficient to run and control the industrial process. Accordingly, in this embodiment no external energy source is required to control an industrial process, such as a hydrocarbon vapor recovery process.

Any BLDT known in the art may be used in any of the processes and devices provided herein. In an aspect, the BLDT comprises a stack of disks selected from a range that is greater than or equal to 2 and less than or equal to 10. In an aspect, each disk of the BLDT has a user-selected surface area range and a separation distance between adjacent disks depending on operating conditions, including operating pressures, flow-rates, viscosity and temperature. In an embodiment any one or more of disk number, separation distance, and surface area are selected to provide sufficient mechanical energy to drive a compressor pump to provide sufficient compression to drive the industrial process and/or one or more components of the industrial process.

In an embodiment, a plurality of BLDT is mechanically coupled to a plurality of compressors. In an embodiment, a plurality of BLDT is mechanically coupled to a compressor.

In an aspect, the flow of pressurized drive fluid is from a pressure vessel containing the pressurized drive fluid. In an embodiment of this aspect, once the pressure of the drive fluid in the pressure vessel is greater or equal to a user-specified value, the drive fluid is released from the pressure vessel, such as by a controller (e.g., a valve), that opens at or above a certain pressure, and the pressure in the vessel drives flow of the drive fluid from the pressure vessel to the BLDT, thereby mechanically powering the compressor connected to the BLDT.

In an embodiment, the pressure vessel is part of a hydrocarbon liquid and gas production unit, including a hydrocarbon vapor recovery unit. For example, the pressure vessel may partially contain liquid hydrocarbon(s), out of which hydrocarbon gas flashes (see, e.g., various storage tanks discussed in U.S. Pat. No. 7,780,766).

In an aspect, the drive fluid is selected from the group consisting of: a vapor gas from a hydrocarbon liquid, water, petroleum, or other natural material related to a hydrocarbon recovery or production process. In an aspect, the compressible fluid is selected from the group consisting of a vapor gas, natural gas, air. In an aspect, the compressible fluid is the same as the drive fluid, such as a hydrocarbon vapor or liquid. In an aspect, the drive fluid is different than the compressible fluid. In an aspect, the compressible fluid introduced to the compressor is a fluid that is stored in a storage tank or is a product of a separation process in a separation tank. In this fashion, any fluid at any point of an industrial process can be introduced to a compressor that is powered by the BLDT as provided herein. In this manner, the processes disclosed herein are widely applicable to a range of industrial processes where pressurization of a fluid is desired or important.

In an embodiment, the pneumatic device is selected from the group consisting of: control valves, motor valves, liquid level controls, temperature controller, pressure controller, and any combination thereof. In an aspect, the drive fluid driving the BLDT comprises natural gas and the compressible fluid comprises air. In an aspect, the compressed air provides on-demand powering of a pneumatic device or for generating a cold air stream with a vortex tube. In an aspect, the compressed air is stored in a retention tank. The retention tank can store compressed air at a high pressure, thereby maintaining compression so that the air is at a suitable pressure for controlling one or more pneumatic devices in the industrial process or for introduction to a vortex tube and attendant temperature and flow rates of the cold air stream. If the air pressure falls below a certain value, the compressor pump may be engaged to provide additional air and/or compression of air within the retention tank. Optionally, various feedback loops can be connected so that the pressure vessel containing the drive fluid is operationally connected to the retention tank, wherein pressure level in the retention tank controls introduction of flowing drive fluid to the BLDT.

In an aspect, the hydrocarbon vapor is recovered from a vapor that is flashed from a hydrocarbon liquid phase in a petroleum recovery facility or a petroleum refinery. Examples of a petroleum recovery facility include a separation facility, a natural gas plant or an offshore oil rig.

In an aspect, the flow of pressurized drive fluid comprises a hydrocarbon vapor from a hydrocarbon liquid in a pressure vessel. Examples of pressure vessels include a storage tank, a low pressure separator, and a temperature separator.

Any of the methods and systems optionally relates to a compressible fluid that is hydrocarbon vapor flashed from hydrocarbon liquid at a vapor pressure that is less a hydrocarbon sales line pressure. In this aspect, the BLDT can be used to increase the pressure of hydrocarbon vapor to a suitable pressure that matches the sales line and accordingly introduced to the sales line. In one embodiment, the hydrocarbon vapor pressure is at least 300 psi less than the hydrocarbon sales line pressure, and after suitable compression, is within at least 5%, 1% or 0.1% of sales line pressure. In an aspect, after compression the vapor pressure is equal or greater than sales line pressure. Appropriate regulators and safety valves may be employed as known in the art, such as a check-valve into the sales line to avoid unwanted back-pressure to the system.

In another aspect, the drive fluid is natural gas, petroleum, water, or any other pressurized fluid that may be part of a recovered material in the industrial process. In an aspect, the drive fluid is a gas. In an aspect, the drive fluid is a liquid.

In an embodiment, the pressurized drive fluid flows in a closed loop, and the method further comprises adjusting a first fluid flow-rate at or over the BLDT by controlling a pressure gradient in the closed loop. In an aspect of this embodiment, the method further comprises monitoring a pressure of the compressed compressible fluid and adjusting the pressure gradient in the closed loop based on the monitored compressed gas pressure. In this manner, the drive fluid flow rate over the BLDT is controlled by the pressure of the compressed compressible fluid, such as when the pressure of the compressed compressible fluid is too low, the flow-rate over the BLDT is increased, thereby increasing compression of the compressible fluid. Correspondingly, if the compressed compressible fluid pressure is sufficiently high, the drive fluid flow over the BLDT can be decreased, the compressor disconnected from the BLDT, or the compressor operably disconnected from the compressible fluid or tank holding the compressible fluid. A controller, such as pneumatic controller of flow may be employed and set to an inverse relation between pressure of the compressed fluid in the tank and flow-rate of the drive fluid. In this fashion, the lower the pressure in the tank holding the compressed fluid, the larger the work by the compressor by higher drive fluid flow rate over the BLDT.

In an embodiment, the compressed compressible fluid is introduced into a sales pipeline, wherein the compressed fluid is fed directly into the sales pipeline or stored in a retention vessel. In this manner, the fluid may be at an appropriate pressure prior to introduction to the sales line. In an aspect, the pressure of the compressed fluid is within at least 5%, 1%, 0.1% of sales line pressure, or is equal or greater than sales line pressure.

In an aspect, the method further relates to processing the stored compressed compressible fluid to purify the compressed fluid prior to introducing the compressed fluid into the sales pipeline. In an aspect, the fluid may be purified by passing the fluid through a filter, or by introducing the compressed fluid to separation tank.

In an embodiment, the method further comprises capturing the directed flow of drive fluid flow from the BLDT and outputting the captured fluid flow into a recovery outlet conduit that is connected to the BLDT. The recovery outlet pipe is optionally directed to a pressure vessel containing the drive fluid (including the original vessel from which the drive fluid is obtained), an outlet line, a compressor, or a heat exchanger for removing condensable hydrocarbon vapor by cooling a collected drive fluid that is hydrocarbon-containing gas.

In another embodiment, provided is a system, device or component for carrying out any of the methods described herein. The system is useful in any process wherein a pressurized drive fluid, such as liquid or gas, is available to drive a turbine, including a boundary layer disk turbine, by fluid flow and the turbine motion used to mechanically power a compressor pump that pressurizes or compresses a fluid. In this manner, the fluid pressurized by the turbine can be used in turn to power pneumatics. In an aspect, the system is used in an industrial process application such as hydrocarbon vapor recovery.

One embodiment of the present invention is directed to a self-powered compressor. "Self-powered" refers to a compressor capable of reliably running for extended periods of time without a source of electrical or chemical energy, and instead relies on fluid flow inherent in the industrial process itself to mechanically drive a compressor. In an aspect, the self-powered compressor comprises a pressure vessel containing a source of pressurized drive fluid, and a closed-loop circuit fluidically connected to a boundary layer disk turbine (BLDT) and the pressure vessel. The closed-loop circuit provides flow of the pressurized drive fluid to the BLDT under a pressure differential without loss or bleeding of the drive fluid. A compressor pump is mechanically connected to the BLDT, wherein flow of the pressurized drive fluid mechanically powers the compressor via the BLDT motion. "Pressurized fluid" refers to the fluid being at a sufficiently high pressure that it is capable of flowing over the BLDT, thereby turning the BLDT. The BLDT is, in turn, mechanically coupled directly or indirectly, to the compressor pump such that motion of the BLDT results in compressor pump compressing a compressible fluid.

In an aspect, the self-powered compressor further comprises a source of air for providing air capable of compression by the compressor pump. The source of air may be from the environment immediately surrounding the compressor. In this aspect, a pneumatic device is fluidically connected to the compressed air, wherein the pneumatic device is controlled by the compressed air.

In an embodiment, a pressure tank is operably connected to the compressor pump and fluidically connected to the pneumatic device, wherein the pump compresses air that is stored in said pressure tank. In this manner, the compressed air is used on-demand to generated a cold air stream and/or to control the pneumatic device depending on the status of a parameter within a location of the industrial process to which the compressor is connected.

In an aspect, the self-powered compressor further comprises a hydrocarbon vapor capable of compression by the compressor pump and a sales line having a sales line pressure that is fluidically connected to the compressed hydrocarbon vapor. In this aspect, the compressor compresses the hydrocarbon vapor to a vapor pressure substantially equal, equal, or equal or greater than the sales line pressure. In this aspect, "substantially equal" refers to a pressure that does not significantly affect the flow of sales gas to or through the sales gas pipeline, such as within 0.1% of the sales line pressure, or greater than or equal to the sales line pressure.

In an embodiment, the self-powered compressor further comprises a retention tank operably connected to the compressor pump, wherein the compressor pump compresses hydrocarbon vapor that is stored in the retention tank.

In an aspect, the self-powered compressor runs continuously. In an aspect, the self-powered compressor runs on-demand, wherein the compressor is automated to engage when operating conditions require compression. In this aspect, a pressure sensor may be positioned to measure pressure in the retention or holding tank of the compressed fluid such as air, and the compressor operably engaged when the pressure sensor measures a pressure that is below a user-selected first set-point pressure and disengages when the measured pressure is above a user-selected second set-point pressure. In an embodiment, the first set-point pressure is less than the second set-point pressure. In an embodiment, the pressure difference between the two set-points is selected from a range that is greater than or equal to 5% and less than or equal to 50%.

Applications for the processes and devices provided herein are numerous and wide-ranging, and encompass the spectrum of hydrocarbon recovery operations. Any application where hydrocarbon gas exists can be recovered and compressed to line pressures using any of the devices and methods provided herein.

Without wishing to be bound by any particular theory, there can be discussion herein of beliefs or understandings of underlying principles or mechanisms relating to embodiments of the invention. It is recognized that regardless of the ultimate correctness of any explanation or hypothesis, an embodiment of the invention can nonetheless be operative and useful.

DETAILED DESCRIPTION OF THE INVENTION

Figure 1:
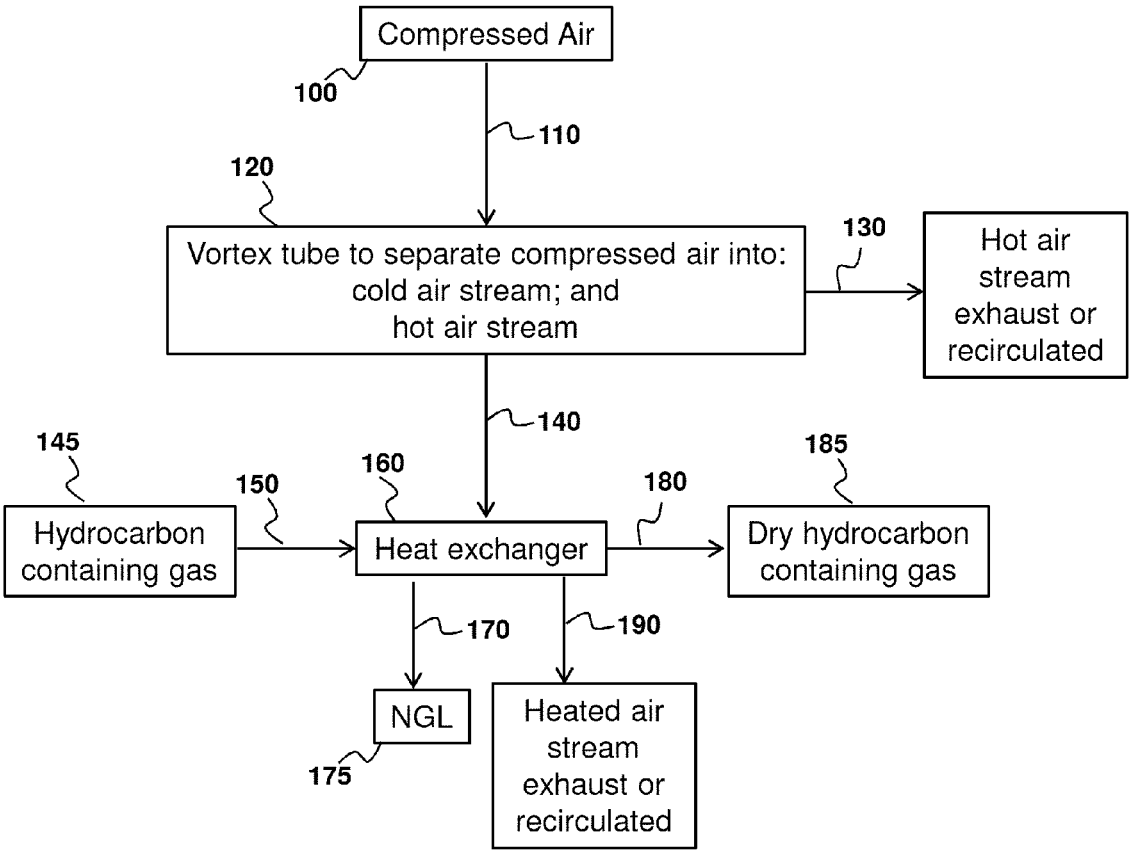
FIG. 1 is a flow-diagram of an embodiment where compressed air is cooled and used to condense natural gas liquids from a hydrocarbon containing gas thereby drying the gas.

The invention may be further understood by the following non-limiting examples. All references cited herein are hereby incorporated by reference to the extent not inconsistent with the disclosure herewith. Although the description herein contains many specificities, these should not be construed as limiting the scope of the invention but as merely providing illustrations of some of the presently preferred embodiments of the invention. For example, thus the scope of the invention should be determined by the appended claims and their equivalents, rather than by the examples given.

"Hydrocarbon containing gas" is used broadly to refer to a gas that contains hydrocarbon materials, such as natural gas from a gas field production or gas from a separator tank. Accordingly, the hydrocarbon containing gas can be a mixture of hydrocarbon gases, including methane and higher-chain carbons such as ethane, propane, butane, etc. "Wet" hydrocarbon containing gas refers to gas containing condensable vapors, such as $C_{2+}$. In the processes provided herein, such condensable vapors are at least partially condensed from the hydrocarbon containing gas by an exchange of heat with a cold air stream so as to condense higher-chain hydrocarbons, thereby increasing the relative amount of methane in the hydrocarbon containing gas (referred herein as "dry" hydrocarbon containing gas). In an aspect, dry refers to at least 95% or greater (by mol %) gas composition is methane. In an aspect, dry refers to a composition that is between 95% and 99%, 97% to 99%, or about 98% to 99% methane (by mol %).

"Natural gas liquid" or "NGL" refers to heavier hydrocarbons that have been condensed from wet hydrocarbon containing gas, such as $C_{2+}$ (e.g., ethane, propane, butane, and higher). The NGL may be a mixture of hydrocarbons or, as desired, individually separated. The NGL collected herein may be stored, provided to a liquid gathering line, or further cooled to generate liquefied natural gas for easier storage or transport.

"Compressed air" refers to air that is at a pressure higher than atmosphere. The compressed air may be directly from a compressor that compresses air to a desired pressure. Alternatively, the compressed air may come from a source of compressed air, such as air stored in a storage tank or vessel and provided on demand.

"Vortex tube" refers to a mechanical device that separates a compressed gas, in this example compressed air, into hot and cold streams. Such vortex tubes are also known in the art as Ranque-Hilsch vortex tubes. Vortex tubes are known in the art, including as described U.S. Pat. Nos. 6,932,858, 5,483,801, 3,208,229, 3,173,273, and 3,775,998 which are specifically incorporated by reference herein for vortex tubes and related components for controlling and processing fluids. Depending on the application of interest and associated operating conditions, a wide range of vortex tubes may be employed herein, so long as the vortex tube provides the desired cooling and flow rates as required by the input wet hydrocarbon containing gas.

Figure 2:
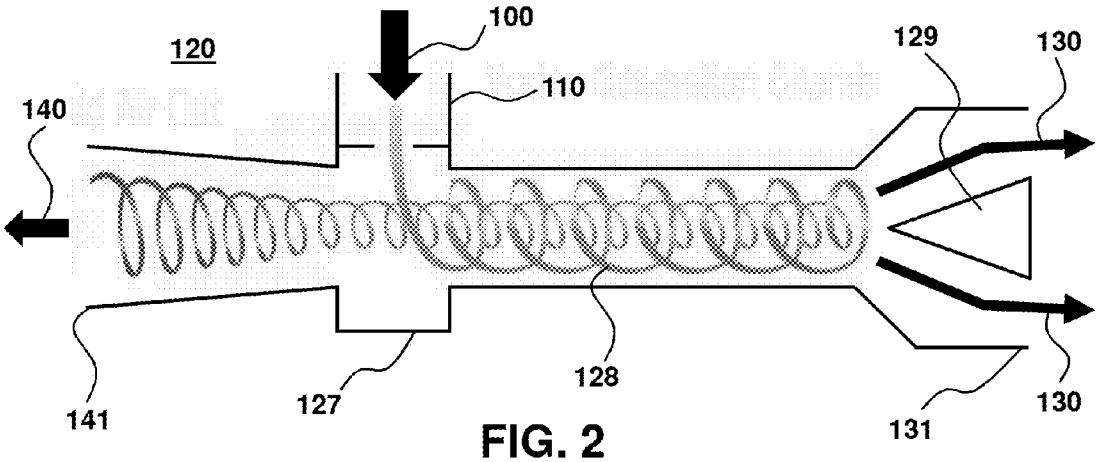
FIG. 2 is a schematic of a vortex tube for cooling compressed air into a cold air stream for subsequent use in a heat exchanger.

Vortex tubes function by taking a tangentially-introduced higher pressure gas (e.g., "compressed air") into a tube's swirl chamber that accelerates the gas to high rate of rotation (see, e.g., FIG. 2). A conically-shaped nozzle at the tube end ensures only the outer shell portion of the centrifugally swirling air exits. The remainder of the air is forced back to the other end of the vortex tube within an inner vortex having a reduced diameter confined within the outer vortex. The outer vortex portion of the air is a hot stream and the inner vortex portion a cold stream. Conventional vortex tubes can produce temperature drops up to and above 100° F., including in the range of about 40° μF.-80° F., such as for air compressed to about 100 psi. Increasing the compression of the air generally increases temperature drop for a given vortex tube. Examples of commercially-available vortex tubes include those by Newman Tools (available on the internet at newmantools.com/vortex.htm).

A controller at the conically-shaped nozzle end may be used to adjust the temperature of the hot and cold air streams, such as to provide a desired cold air stream temperature tailored to the application and operating conditions of interest.

"Heat exchanger" refers to high thermal efficiency exchangers that provides thermal contact between two fluids of different temperatures. The term is used broadly and includes counter-current, parallel flow, and cross-flow exchangers. In the context of the current invention, the two fluids are a cold air stream and a hydrocarbon containing gas, wherein the heat exchanger inlet temperature of the hydrocarbon containing gas is higher than the inlet temperature of the cold air stream. Accordingly, thermal contact between the cold air stream and the hydrocarbon containing gas stream within the heat exchanger facilitates net heat flow from the hydrocarbon containing stream, thereby lowering the temperature of the hydrocarbon containing gas stream and correspondingly increasing the temperature of the cold air stream to a heated air stream temperature. For wet hydrocarbon containing gas, such a lowering of temperature facilitates condensation of certain hydrocarbon vapors, such as heavier hydrocarbons, into NGL. The NGL is separated from the gas stream and collected leaving a dry hydrocarbon containing gas stream to exit the heat exchanger. For robust heat exchange, the flow path is shaped so as to maximize surface area available for heat exchange, and may be optionally split to provide good thermal contact between the flowstreams. In addition, one or more surfaces may be shared between the fluid conduits, with the hydrocarbon containing gas on one side of the surface and the cold air stream on the opposite side to further increase heat exchange. Any of the conduits may be shaped to enhance heat exchange. Furthermore, heat sinks may be utilized to further control thermal transfer characteristics.

"Fluidically connects" or "fluidically connected" refers to two components that are connected such that a fluid is transported between the components while functionality of each component is maintained.

"Industrial process" refers to a procedure used in the manufacture or isolation of a material. For example, the industrial process may involve chemical or mechanical steps used in a hydrocarbon generation, recovery procedure, or process, such as for a hydrocarbon vapor recovery unit from a hydrocarbon recovery, separation, and/or storage facility.

"Mechanically coupling" refers to a connection between two components, wherein movement of one component generates movement in another component without affecting the function of the components. The coupling can be direct, such as by a rotating shaft that is attached to two components. Alternatively, the coupling may be indirect such that there is one or more intervening components or materials between two devices, such as a belt, pulley and/or clutch.

"BLDT" or "boundary layer disk turbine", also referred to as a "Tesla turbine" (see U.S. Pat. No. 1,061,206) or a "Prandtl layer turbine" (see U.S. Pat. No. 6,174,127), refers to a stack of disks that are spaced apart and rotably mounted on a shaft. In this manner, flow of a fluid between adjacent disks generates disk rotation and corresponding rotation of shaft on which the BLDT is mounted. In this manner, fluid flow over a BLDT can generate energy in the form of a shaft rotation that can be usefully harnessed to control, or at least partially control, an industrial process.

"Pressurized drive fluid" refers to a drive fluid that is under sufficient pressure at one point compared to another point so as to generate fluid flow between the points. For example, to power a BLDT, the fluid is pressurized upstream of the BLDT compared to downstream of the BLDT, so that fluid flows over the BLDT, thereby providing mechanical rotation of the BLDT.

"Compressing" refers to increasing the pressure of a gas, such as by introducing additional gas to a fixed volume or by reducing the volume of the gas. Accordingly, compressing may be achieved by one or more of a pump and a compressor. Various compressors may be used to compress gas (referred herein as a "compressible gas"). Examples of compressors include centrifugal, axial-flow, reciprocating and rotary. Alternatively, a pump may be used to force additional gas into a fixed volume. "Compressor pump" refers to any component capable of compressing a fluid, such as gas or air.

"Mechanical power" refers to a device that is powered by mechanical motion arising from flow of fluid over a BLDT.

"Electrical power", in contrast, refers to a device requiring electricity to function. "Chemical power" refers to a device that is powered by a chemical process, such as by combustion. Because electrical and/or chemical power requires external input from an energy source, that power is referred to as an "external" energy source. One advantage of the processes and systems described herein is that the mechanical power can significantly reduce, or avoid altogether a need for external power, but instead leverages an inherent property of the industrial process itself, namely flow of a pressurized fluid (referred herein as a "drive fluid"). Accordingly, the mechanical power of the present invention is referred to as an "internal" energy source.

"Pneumatic device" refers to a device that is mechanically controlled by the use of a pressurized gas. Examples of pneumatic devices useful in a number of industrial processes provided herein include: pressure regulator, pressure sensor, pressure switch, pumps, valves, compressors or actuator.

"Closed loop" refers to a material, such as a fluid, that is not lost to the environment, but instead is contained within the industrial process and either fed back into the process for re-use or is captured and fed to a collector or an outlet and provided to a sales pipeline.

A compressor that is "electric free" and "gas free" refers to a compressor that is capable of solely operating by virtue of the BLDT within the industrial process. In other words, the energy required to power the compressor is internal and no external energy source is required or needed. This results in significant energy savings, including for industrial processes that may be in geographically isolated areas, or in areas where an available external energy source (e.g., the grid), is not readily accessible.

Example 1: Drying a Hydrocarbon-Containing Gas

One example of a process for drying a hydrocarbon-containing gas is provided by the process flow chart of FIG. 1. Compressed air 100 is introduced 110 to a vortex tube 120. The compressed air 100 may be directly from a compressor or indirectly from a compressor such as via storage tank. The vortex tube 120 separates the compressed air into a hot air stream 130 and a cold air stream 140. The cold air stream 140 is introduced to a heat exchanger 160. Hydrocarbon containing gas (e.g., wet hydrocarbon containing gas) 150, such as from a source 145 is introduced to the heat exchanger 160. Functionally, the cold air stream 140 decreases the temperature of the hydrocarbon containing gas in the heat exchanger, thereby condensing natural gas vapors in the hydrocarbon containing gas to liquid hydrocarbons (referred herein as natural gas liquids or NGL) 170 that are collected 175 from the heat exchanger. Hydrocarbon containing gas from which NGLs have been condensed is referred to as dry hydrocarbon containing gas 180, and is collected 185 from the heat exchanger 160. Cold air stream 140 is accordingly heated and exits the heat exchanger as a heated air stream 190 that may be vented to atmosphere or recirculated such as being used in another aspect of an industrial process where heating is required or beneficial.

FIG. 2 is a schematic illustration of a vortex tube 120. Compressed air 100 is introduced to vortex tube via compressed air conduit 110. Chamber 127 generates a vortex that transits along vortex conduit 128 with an outer portion of the vortex released as hot air stream 130 at a second end 131 and cold air stream 140 corresponding to inner portion of the vortex released at the first end 141 of the vortex tube. A vortex tube control valve 129 provides the ability to control the temperature of hot air stream 130 and cold air stream 140, such as by controlling the fraction of inlet air released at the hot air stream 130 end. As discussed, by increasing the pressure of compressed air 100 introduced to vortex tube 120, the temperature of the cold air stream 140 is further decreased. In an aspect, operating conditions and vortex tube geometry is selected so as to provide a cold air stream temperature out of the vortex tube that is less than about 0° F.

Figure 3:
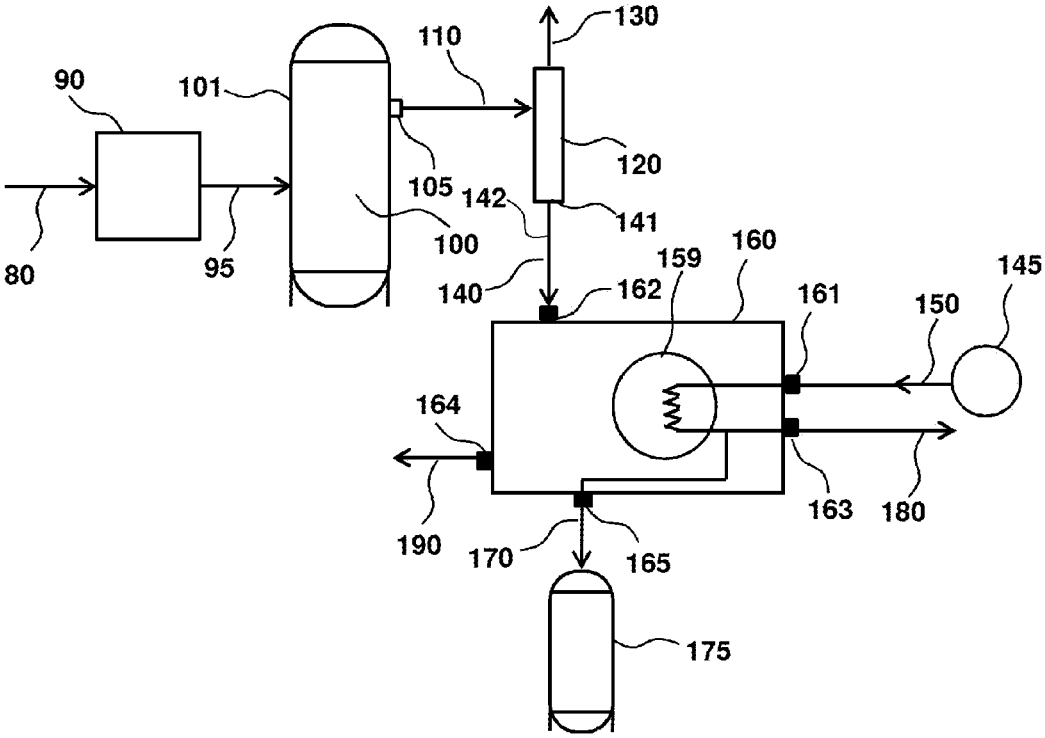
FIG. 3 is a schematic of a heat exchanger system that utilizes a cold air stream to condense NGL from a hydrocarbon containing gas stream.

FIG. 3 is a schematic of the process outlined in FIG. 1 where a vortex tube 120 is used to provide cold air stream 140 to a heat exchanger 160 having a thermal transfer zone 159 by cold air stream conduit 142. Compressor 90 compresses air, such as atmospheric air provided at air inlet 80. Compressed air conduit 95 fluidically connects the compressor and a compressed air storage tank 101. Compressed air 100, such as from a compressed air storage tank 101, is provided to vortex tube 120 via compressed air conduit 110. Various flow regulation means, such as valves or controllers as indicated by 105, are used throughout the system as desired, to provide appropriate regulation of a physical parameter, such as flow-rates or pressures. In FIG. 3, valve or controller 105 controls the flow or pressure of compressed air to vortex tube 120. Cold air stream 140 from the vortex tube 120 is introduced to heat exchanger 160 at a second inlet 162. Wet hydrocarbon containing gas 150 is introduced from a hydrocarbon source 145 to the heat exchanger 160 at a first inlet 161. Thermal contact between the cold air stream 140 and wet hydrocarbon containing gas 150 lowers the temperature of the gas 150, thereby condensing vapors in the hydrocarbon containing gas 150, to generate natural gas liquids (NGL) 170, such as from heavy chain hydrocarbon vapor within the hydrocarbon containing gas. The resultant hydrocarbon containing gas is referred to as dry hydrocarbon containing gas 180 and is removed from heat exchanger 160 at first outlet 163 for further processing, storage, sales or combustion. Thermal contact between cold air stream 140 and hydrocarbon containing gas 150 correspondingly heats the cold air stream to a heated air stream 190 which exits heat exchanger 160 at second outlet 164. Condensed NGL 170 is removed from the heat exchanger at third outlet 165 and sold or, as illustrated, stored in a NGL storage tank 175 for later sale or for further processing.

The term heat exchanger is used broadly and refers to any device or system that provides cooling of a fluid by another fluid that is of higher temperature. In its most simple form, the heat exchanger may be flow conduits that are in physical contact to provide heat transfer. In such an aspect, the terms "inlet" and "outlet" reduce to a position in each conduit wherein there is a substantial heat transfer between the fluids. This can be defined as measurable change in the temperature, such as a change that is at least 1° C., at least 5° C., or a range that is between about 1° C. to 10° C. Accordingly, there are defined two inlets and two outlets, with an inlet/outlet pair for the hydrocarbon stream conduit (150 180) that will be cooled and another inlet/outlet pair for the air stream conduit (140 190) that provides the cooling. A third outlet is provided to remove condensed liquid from a position where liquid condensate locates (e.g., 165 or other convenient location within the conduit defined by 150 and 180 having reduced temperature).

One advantage of the systems and processes provided herein is that they are compatible with other low-energy systems, where minimal externally input energy is required to drive and control the system and simultaneously, revenue-producing product may be generated and collected. Systems provided herein are cost-effective in that efficiencies are realized by avoiding the refrigerant liquids required in conventional cooling systems. Instead, the systems provided herein use compressed air and a vortex tube. In particular, referring to FIGS. 1-3, no external energy sources are required, as the flow of various fluids under pressure provide the cooling effect. In other words, the most energy-intensive requirement is to ensure there is sufficient compressed air 100 introduced to the vortex tube 120. The other aspects of the system summarized in FIG. 3 rely mainly on passive forces such as fluid pressures or gravity to drive fluid flow.

To keep external energy requirements low or absent, the compressed air may be obtained by incorporating the low-energy systems disclosed in U.S. Pat. Pub. Nos. 2013/0071259 and 2013/0068314, each filed Sep. 14, 2012 specifically incorporated by reference for the air compression, control devices and processes described therein. For example, a boundary layer disk turbine (BLDT) may be used to drive a compressor 90, thereby obtaining compressed air without an external energy power source as further explained in Example 2 and FIGS. 4-6 discussed below.

Example 2: Self-Powered Compressor to Compress Fluids

Figure 4:
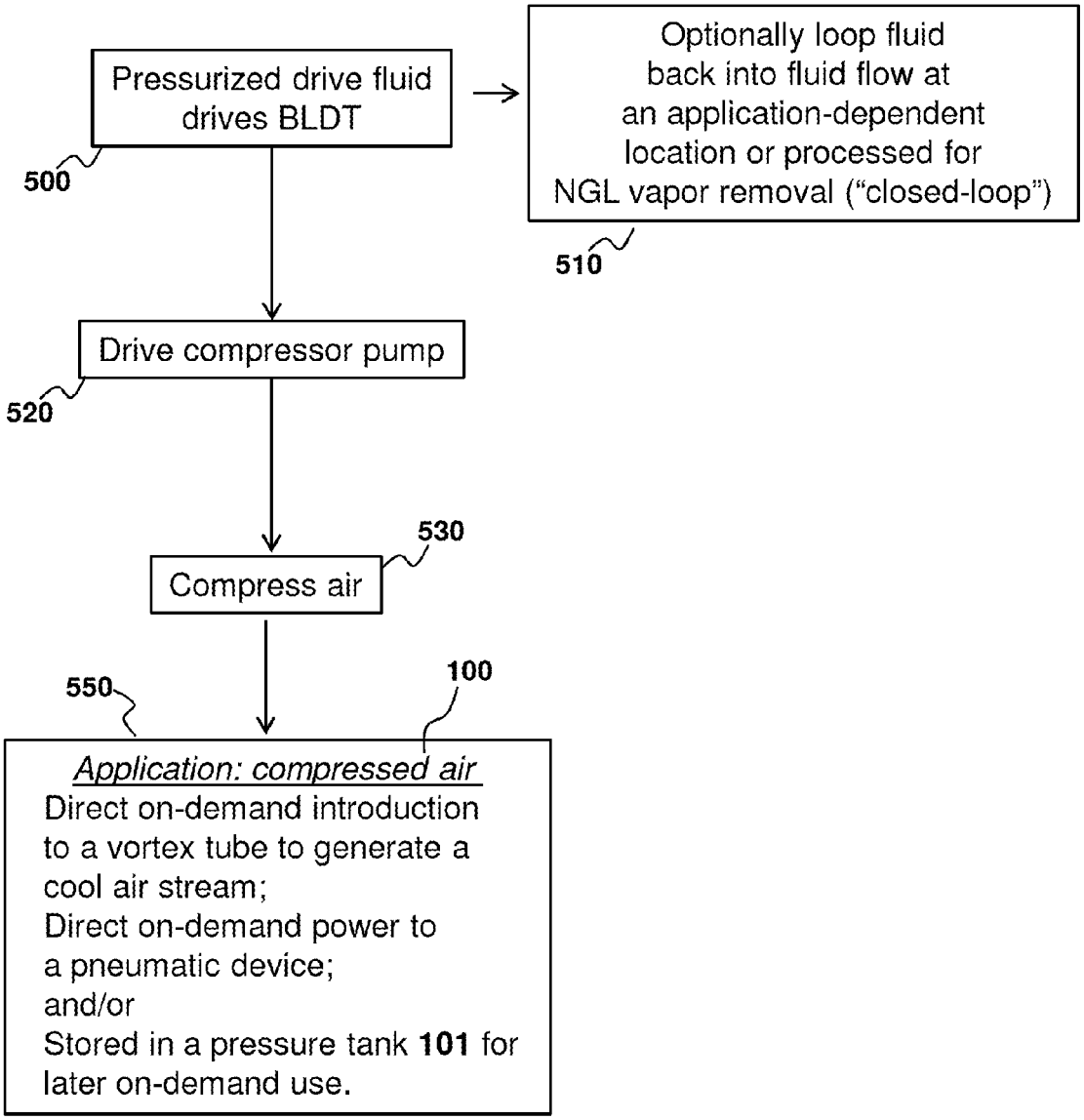
FIG. 4 is a flow-diagram of one embodiment where kinetic energy in the form of fluid flow is used to compress air without an external source of energy.
Figure 5:
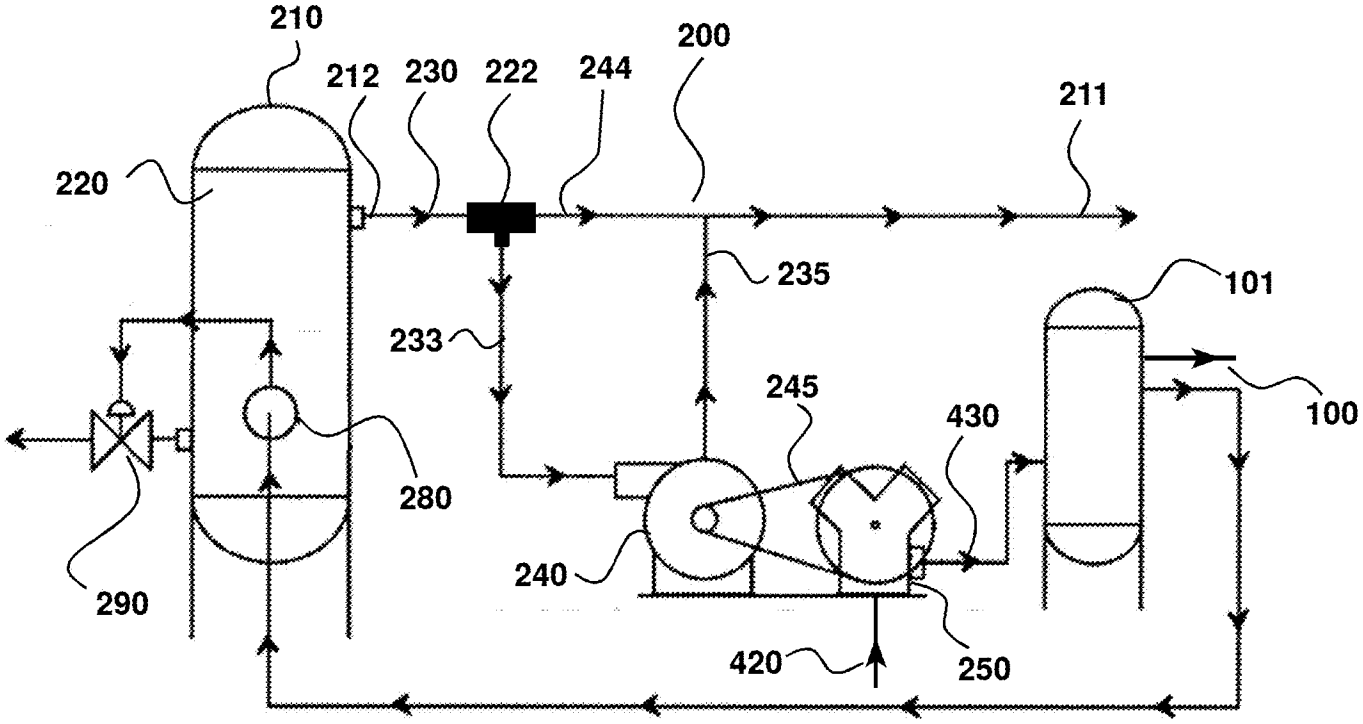
FIG. 5 is a schematic of a boundary layer disk turbine to compress air and optionally a pneumatic device within an industrial process.

FIG. 4 summarizes certain steps of a process for compressing a fluid, such as air for use in the process and devices described in Example 1. Briefly, pressurized drive fluid drives a disk turbine (e.g., BLDT) 500 and is looped back into the fluid flow at an appropriate location in the process 510. For example, FIG. 5 illustrates the outlet flow conduit 235 from the BLDT connected back to a line from the pressure vessel 210 or another line 211, such as a sales line or a hydrocarbon-containing gas line that is introduced to heat exchanger 160 of FIGS. 1 and 3. Because the fluid remains in the industrial process and is not, for example, vented to atmosphere, the connection is referred to as a "closed-loop" 200. The BLDT drives a compressor pump 520 through any coupling means, direct or indirect. The compressor pump compresses a compressible fluid 530, such as air to provide compressed air 100. Depending on the desired application 550, the compressed air may be stored in a retention tank or pressure tank 101 (see FIG. 3) for use in cooling a hydrocarbon containing gas and/or directly to power a pneumatic process control in the system. On demand, the compressed fluid in the retention or pressure tank or directly from the compressor pump powers a pneumatic device, or is directed to a vortex tube 120. Examples of a pneumatic device or controller include a dump valve, motor valve, level controller, temperature or pressure controller.

In an aspect, the pneumatic control by a BLDT is part of a staged-separation process. For example, referring to FIG. 4, the pressurized drive fluid 500 can be derived from a high-pressure well-head stream, or can be a from a separation tank that provides a lower drive fluid pressure, or a combination thereof. In this manner, the processes and devices provided herein can be used at any point in the hydrocarbon recovery industrial process, ranging from relatively upstream points near the well-head to more downstream processing, storage and sales points; anywhere where self-control of a pneumatic device and/or cooling using compressed is desired. In this aspect, a number of BLDT can be introduced throughout the industrial process, thereby providing control of pneumatic devices and cooling throughout hydrocarbon production, processing and recovery. One important aspect of the industrial processes provided herein is a compressor pump that is powered by fluid flow, wherein the fluid flow is an inherent part of the industrial process and external energy input is not required to generate the flow or power the compressor. This aspect is referred to as a "self-powered compressor" as no external source of energy is required to drive the compressor, but the inherent high pressure of the drive fluid is harnessed to generate mechanically-based compression. The action of the compressor can itself be harnessed to provide useful control of various aspects of the industrial process without relying on an external energy source (see, e.g., the process flows summarized FIGS. 1-3 of Example 1). This can significantly reduce the cost of the process by not only minimizing external power consumption, but by avoiding additional components, increasing reliability of the process, and reducing unwanted emissions. A particularly relevant application of the self-powered compressor aspect is to provide compressed air on-demand for use in any of the processes provided herein for recovering NGL from a hydrocarbon containing gas, as indicated by 100 of FIGS. 1-3.

FIG. 5 is a schematic that summarizes a method and system where a BLDT is used in a process to compress a fluid, and optionally provide pneumatic control. A pressure vessel 210 contains a source of pressurized drive fluid 220 and controller 212. Pressurized fluid 220 provides a flow of a pressurized drive fluid 230 over a BLDT 240 that is mechanically coupled to a compressor pump 250 (which may correspond to compressor pump 90 of FIG. 3) by mechanical coupling 245. In this fashion, the pressurized drive fluid 230 flowing over the BLDT 240 mechanically powers compressor pump 250. Compressor pump 250 compresses a compressible fluid 420, such as air. Compressed fluid 430 is directed into a retention tank 101 (which may correspond, for example, to tank 101 of FIG. 3). The compressed fluid can be used in a subsequent process, such as the compressed air 100 of FIGS. 1-3 for cooling hydrocarbon containing gas, to run controls, including a pneumatic device such as a level controller 280 and/or a dump valve 290. The dump valve regulates the amount of liquid removed from pressure vessel 210. In this example, the drive fluid may be a hydrocarbon gas such as a natural gas that is contained in a closed loop 200 and fed to an outlet flow conduit 235 or collecting line 211. The hydrocarbon gas in collecting line 211 may correspond to hydrocarbon containing gas source 145 of FIG. 3. The pneumatic control being powered or controlled may also be at other locations in the industrial process, such as another valve controlling the process, or other separation, retention or processing tank or pipeline. Optionally, flow regulator 212 and/or valve 222 can control pressures or flow-rates, including the relative flow-rates between BLDT inlet conduit 233 ("first" flow-rate) and bypass conduit 244 ("second" flow rate). Similar regulators or valves may be used to control relative flow rates between the cold air stream 140 and hot air stream 130, such as by controlling vortex tube control valve 129.

Figure 6A:
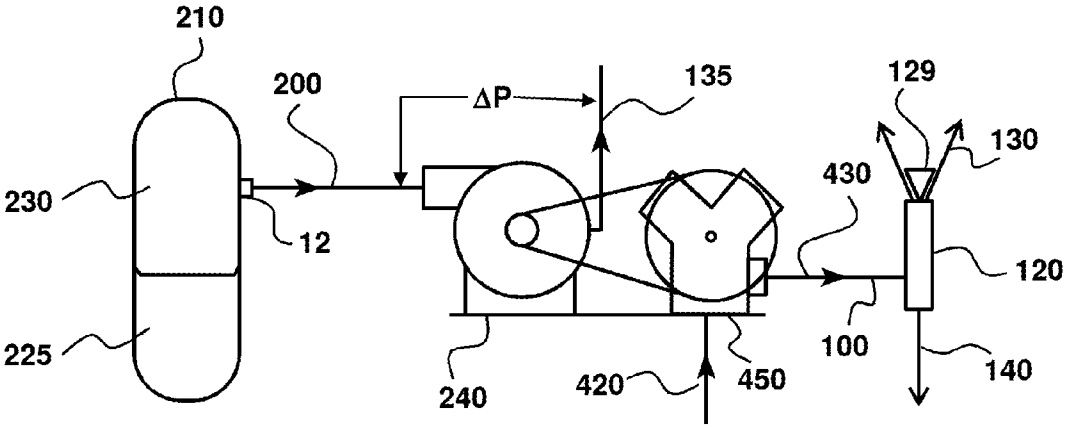
FIG. 6A is a self-powered compressor for compressing a fluid such as air.

FIG. 6 provides an example of a self-powered compressor, similar to that employed in FIG. 5. Referring to FIG. 6A, a pressure vessel 210 contains a source of pressurized drive fluid 230, such as hydrocarbon vapor flashed from hydrocarbon liquid 225, such as from a hydrocarbon production facility (e.g., a well) or a hydrocarbon storage or holding tank. The hydrocarbon vapor may be obtained directly from the well, or may be generated from gas flashing from a liquid phase downstream in the industrial process. The pressurized fluid (also referred to as drive fluid) 230 is introduced to fluid conduit 200 that fluidically connects the vessel 210 and a BLDT 240 by controller 12. "Fluidically connected" refers to conduit 200 configured to provide flow of pressurized drive fluid from the vessel 210 to and over the BLDT 240 under a pressure gradient or differential, as indicated by ΔP. Mechanical motion of BLDT 240 by drive fluid 230 flowing through conduit 200 drives compressor pump 250 that is capable of compressing a compressible fluid 420, such as air from an air source. In an aspect, the air source is ambient air in the vicinity of the compressor pump 250 fluid inlet. Compressed air 430 can then be used to power a pneumatic device 320 as discussed above, and in U.S. patent application Ser Nos. 13/617,313 and 13/617,167. With respect to the instant application for drying hydrocarbon gas, the compressed air 430 may correspond to compressed air 100 introduced at step 110 to the vortex tube 120, as outlined in FIG. 1 and illustrated in FIGS. 2-3.

Figure 6B:
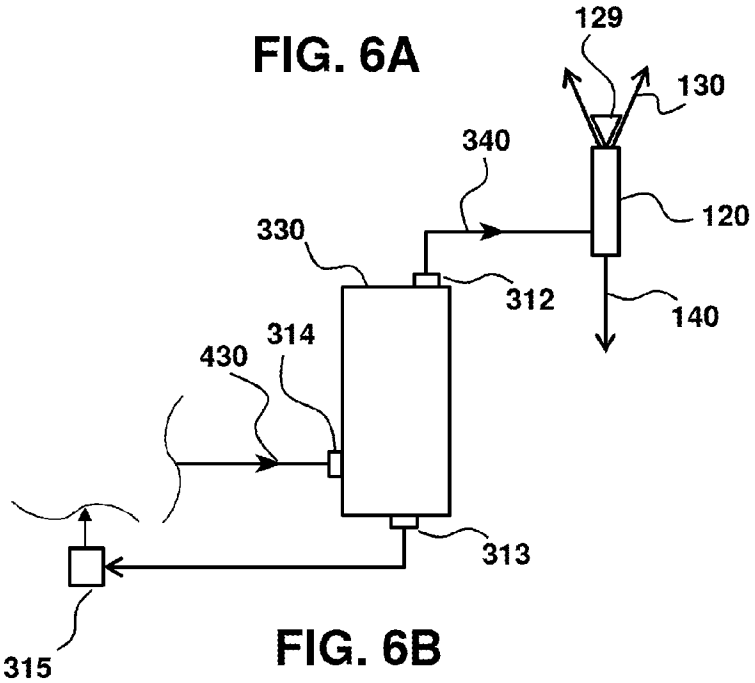
FIG. 6B shows an embodiment where compressed air is stored in a storage tank for subsequent use or on-demand use in a cooling process of any of the devices or processes provided herein.

For simplicity, FIG. 6A illustrates output of compressed air 100 ready for use in the process illustrated in FIG. 1. Use of appropriate valves and controllers provides the ability to adjustably select the pressure of the compressed air, as desired, for introduction to the vortex tube. The system, however, may be used for multiple functionality, such as controlling multiple pneumatic devices and/or for introduction to multiple vortex tube(s) as desired, such as by providing compressed air 430 to multiple devices. FIG. 6B illustrates an embodiment where compressed air 430 is stored in a pressure tank 330 (e.g., corresponding to tank 101 of FIGS. 1-3). The pressure tank 330 is fluidically connected to a vortex tube 120 by outlet conduit 340. In this manner, a large reservoir of pressurized fluid, including pressurized air, can be maintained and used on-demand by operation of controller 312 or 314. The positions of the inlet and outlet to any of the vessels disclosed herein, including tanks 210, 101 (FIG. 3) or 330, are not important, but instead are located as desired, including along a side, top or bottom of the tank, as desired. A pressure sensor 313 can measure and monitor pressure in the tank 330 and be used to control the BLDT/compressor by a controller 315 so that compression occurs when the pressure measured by sensor 313 is below a first user-selected set-point and, similarly, compression ends when the pressure is above a second user selected set-point, such as a second set-point greater than the first set-point.

Integrating the systems and processes described in Examples 1 and 2 with each other, provides a robust, simple and cost-effective manner for further processing hydrocarbon containing gas without expending additional energy. Accordingly, the systems provided herein are particularly suited for applications where the electrical grid is not readily available and are further advantageous in that there are no or minimal moving components and cooling fluid is readily available from the surrounding ambient air. Accordingly, maintenance and upkeep of the systems are extremely minimal.

Any of the devices and processes described herein further comprise, depending on the application, components known in the art for controlling industrial processes including, valves, regulators, rig-out, sensors (pressure, temperature, flow-rate), conduits or flow lines, piping, containers, containment vessels, separators, filters, mixers. Each application includes corresponding safety devices, valves, primary and secondary pressure and flow controllers and corresponding pressure and flow rates. Each application may vary in configuration or geometry, while maintaining the overall central aspect of the invention, including aspects described as: a pressurized fluid to drive a BLDT that is looped back into the fluid flow at an appropriate location in the process.

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

All patents and publications mentioned in the specification are indicative of the levels of skill of those skilled in the art to which the invention pertains. References cited herein are incorporated by reference herein in their entirety to indicate the state of the art, in some cases as of their filing date, and it is intended that this information can be employed herein, if needed, to exclude (for example, to disclaim) specific embodiments that are in the prior art. For example, when a compound is claimed, it should be understood that compounds known in the prior art, including certain compounds disclosed in the references disclosed herein (particularly in referenced patent documents), are not intended to be included in the claim.

When a Markush group or other grouping is used herein, all individual members of the group and all combinations and subcombinations possible of the group are intended to be individually included in the disclosure. Every formulation or combination of components described or exemplified can be used to practice the invention, unless otherwise stated. Whenever a range is given in the specification, for example, a temperature range, a time range, or a pressure range, all intermediate ranges and subranges, as well as all individual values included in the ranges given are intended to be included in the disclosure.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

I claim:

1. A process for recovering natural gas liquid from a hydrocarbon containing gas, said method comprising the steps of:

mechanically coupling a boundary layer disk turbine (BLDT) to a compressor pump;

directing a flow of pressurized fluid of the BLDT to mechanically power the compressor pump;

compressing air with the mechanically powered compressor pump; thereby generating compressed air without an external energy source;

introducing said compressed air to a vortex tube;

separating the introduced compressed air in the vortex tube into a hot air stream and a cold air stream;

introducing the cold air stream into a heat exchanger;

introducing the hydrocarbon containing gas into the heat exchanger, wherein the cold air stream in the heat exchanger cools the hydrocarbon containing gas thereby condensing natural gas vapors in the hydrocarbon containing gas to liquid hydrocarbons;

collecting the liquid hydrocarbons from the heat exchanger; and collecting a dry hydrocarbon containing gas from the heat exchanger;

thereby recovering natural gas liquid from the hydrocarbon containing gas without an external energy source.

2. The process of claim 1, wherein the introduced compressed air has a pressure selected from a range that is greater than or equal to 80 psi and less than or equal to 120 psi.

3. The process of claim 1, wherein the introduced compressed air has a temperature selected from a range that is greater than or equal to 50° F. and less than or equal to 90° F.

4. The process of claim 1, wherein the introduced compressed air has a temperature that is within 10° F. of surrounding ambient air temperature.

5. The process of claim 1, wherein the cold air stream from the vortex tube has a temperature selected from a range that is greater than or equal to −20° F. and less than or equal to 20° F.

6. The process of claim 1, wherein the cold air stream has an exit temperature from the vortex tube that is at least 30° F. to 100° F. less than an introduction temperature of the introduced compressed air.

7. The process of claim 1, wherein the cold air stream has a user-selected flow rate.

8. The process of claim 1, wherein the compressed air is stored in a storage tank.

9. The process of claim 1, wherein the pressurized drive fluid is a vapor gas from a hydrocarbon containing liquid.

10. The process of claim 1, further comprising the step of providing on-demand control of a pneumatic device within the process.

11. The process of claim 1, wherein the hydrocarbon containing gas introduced to the heat exchanger is from a separation tank or a production field and comprises condensable hydrocarbons of C2 or greater.

12. The process of claim 11, wherein the mole percentage of the condensable hydrocarbons is 20% or greater.

13. The process of claim 1, wherein the collected dry hydrocarbon gas comprises methane hydrocarbons in an amount that is greater than or equal to 95 mol %.

14. The process of claim 1, wherein the collected dry hydrocarbon gas is provided to a sales line or combusted.

15. The process of claim 1, wherein the collected NGL comprises one or more of: ethane, butane or propane.

16. The process of claim 1, wherein the collected NGL is stored in a containment vessel or introduced to a sales pipeline.

17. An apparatus for recovering natural gas liquids from a hydrocarbon-containing gas, the apparatus comprising:

a heat exchanger comprising:

a first inlet for receiving a hydrocarbon stream comprising wet natural gas, a first outlet for releasing a cooled hydrocarbon stream that is dry natural gas from the hydrocarbon stream, a second inlet for receiving a cold air stream;

a second outlet for releasing a heated air stream, wherein the cold air stream and the hydrocarbon stream comprising wet natural gas are in thermal contact, and the cold air stream cools the hydrocarbon stream to provide the dry natural gas and the heated air stream; and a third outlet for releasing a condensed natural gas liquid (NGL) from the cooled hydrocarbon stream;

a vortex tube for separating compressed air into the cold air stream at a first end and a hot air stream at a second end;

a cold air stream conduit that fluidly connects the vortex tube first end to the heat exchanger second inlet for introducing the cold air stream to the heat exchanger; and a NGL collection vessel connected to the heat exchanger third outlet for collecting a condensed NGL from the cooled hydrocarbon stream;

a self-powered compressor that provides compressed air to the vortex tube, said self-powered compressor comprising:

a boundary layer disc turbine (BLDT);

a source of pressurized drive fluid;

a pressurized drive fluid conduit that fluidically connects the BLDT and the source of pressurized drive fluid;

a compressor pump mechanically connected to the BLDT;

an air source fluidically connected to the compressor pump;

wherein flow of pressurized drive fluid under a pressure differential mechanically powers the compressor pump to compress air to a desired pressure for introduction to the vortex tube.

18. The apparatus of claim 17, further comprising a compressed air storage tank fluidically connected to the compressor pump for storing compressed air.

* * * * *